US005409596A

United States Patent [19]

Fletcher et al.

[11] Patent Number: 5,409,596

[45] Date of Patent: * Apr. 25, 1995

[54] HYDROCARBON UPGRADING PROCESS

[75] Inventors: David L. Fletcher, Turnersville; Michael S. Sarli, Haddonfield; Stuart S. Shih, Cherry Hill, all of N.J.

[73] Assignee: Mobil Oil Corporation, Fairfax, Va.

[ * ] Notice: The portion of the term of this patent subsequent to Sep. 13, 2011 has been disclaimed.

[21] Appl. No.: 850,106

[22] Filed: Mar. 12, 1992

Related U.S. Application Data

[63] Continuation-in-part of Ser. No. 745,311, Aug. 15, 1991, Pat. No. 5,346,609.

[51] Int. Cl.[6] ..... C10G 69/02

[52] U.S. Cl. ..... 208/89; 208/211; 208/213; 208/58

[58] Field of Search ..... 208/58, 211, 89, 213

[56] References Cited

U.S. PATENT DOCUMENTS

| | | | |
|---|---|---|---|
| 3,458,433 | 7/1969 | Wood et al. | 208/89 |
| 3,549,515 | 12/1970 | Braunard et al. | 208/89 |
| 3,663,424 | 5/1972 | Jaffe | 208/89 |
| 3,728,251 | 4/1973 | Kelley et al. | 208/89 |
| 3,759,821 | 9/1973 | Brennan et al. | 208/93 |
| 3,767,568 | 10/1973 | Chen | 208/134 |
| 3,923,641 | 12/1975 | Morrison | 208/111 |
| 3,957,625 | 5/1976 | Orkin | 208/211 |
| 4,049,542 | 9/1977 | Gibson et al. | 208/213 |
| 4,057,488 | 11/1977 | Montagana | 208/89 |
| 4,062,762 | 12/1977 | Howard et al. | 208/211 |
| 4,210,521 | 7/1980 | Gorring et al. | 208/89 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/12 |
| 5,000,839 | 3/1991 | Kirker et al. | 208/89 |
| 5,143,596 | 9/1992 | Maxwell et al. | 208/89 |

OTHER PUBLICATIONS

Handbook of Petroleum Refining Processes R. Meyers pp. 5-16-5-23 UCC (Shell Hysomer Process.

*Primary Examiner*—Helane Myers
*Attorney, Agent, or Firm*—A. J. McKillop; M. D. Keen

[57] ABSTRACT

Low sulfur gasoline of relatively high octane number is produced from a catalytically cracked, sulfur-containing naphtha by hydrodesulfurization followed by treatment over an acidic catalyst, preferably an intermediate pore size zeolite such as ZSM-5. The treatment over the acidic catalyst in the second step restores the octane loss which takes place as a result of the hydrogenative treatment and results in a low sulfur gasoline product with an octane number comparable to that of the feed naphtha. In favorable cases, using feeds of extended end point such as heavy naphthas with 95 percent points above about 380° F. (about 193° C.), improvements in both product octane and yield relative to the feed may be obtained.

29 Claims, 6 Drawing Sheets

HYDROCARBON UPGRADING PROCESS

CROSS REFERENCE TO RELATED APPLICATIONS

This application is a continuation-in-part of our prior application Ser. No. 07/745,311, filed 15 Aug. 1991, now U.S. Pat. No. 5,346,609, issued Sep. 13, 1994.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Heavy petroleum fractions, such as vacuum gas oil, or even resids such as atmospheric resid, may be catalytically cracked to lighter and more valuable products, especially gasoline. Catalytically cracked gasoline forms a major part of the gasoline product pool in the United States. It is conventional to recover the product of catalytic cracking and to fractionate the cracking products into various fractions such as light gases; naphtha, including light and heavy gasoline; distillate fractions, such as heating oil and Diesel fuel; lube oil base fractions; and heavier fractions.

Where the petroleum fraction being catalytically cracked contains sulfur, the products of catalytic cracking usually contain sulfur impurities which normally require removal, usually by hydrotreating, in order to comply with the relevant product specifications. These specifications are expected to become more stringent in the future, possibly permitting no more than about 300 ppmw sulfur in motor gasolines. In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina.

Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

In the hydrotreating of petroleum fractions, particularly naphthas, and most particularly heavy cracked gasoline, the molecules containing the sulfur atoms are mildly hydrocracked so as to release their sulfur, usually as hydrogen sulfide. After the hydrotreating operation is complete, the product may be fractionated, or even just flashed, to release the hydrogen sulfide and collect the now sweetened gasoline. Although this is an effective process that has been practiced on gasolines and heavier petroleum fractions for many years to produce satisfactory products, it does have disadvantages.

Naphthas, including light and full range naphthas, may be subjected to catalytically reforming so as to increase their octane numbers by converting at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute substantial volume to the gasoline pool, but they do not generally contribute significantly to higher octane values without reforming.

Cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool. Therefore, it is a most desirable component of the gasoline pool, and it should not be lightly tampered with.

Other highly unsaturated fractions boiling in the gasoline boiling range, which are produced in some refineries or petrochemical plants, include pyrolysis gasoline. This is a fraction which is often produced as a by-product in the cracking of petroleum fractions to produce light unsaturates, such as ethylene and propylene. Pyrolysis gasoline has a very high octane number but is quite unstable in the absence of hydrotreating because, in addition to the desirable olefins boiling in the gasoline boiling range, it also contains a substantial proportion of diolefins, which tend to form gums after storage or standing.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Other processes for treating catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

SUMMARY OF THE INVENTION

We have now devised a process for catalytically desulfurizing cracked fractions in the gasoline boiling range which enables the sulfur to be reduced to acceptable levels without substantially reducing the octane number. In favorable cases, the volumetric yield of gasoline boiling range product is not substantially reduced and may even be increased so that the number of octane barrels of product produced is at least equivalent to the number of octane barrels of feed introduced into the operation.

The process may be utilized to desulfurize light and full range naphtha fractions while maintaining octane so as to obviate the need for reforming such fractions, or at least, without the necessity of reforming such fractions to the degree previously considered necessary. Since reforming generally implies a significant yield loss, this constitutes a marked advantage of the present process.

According to the present invention, a sulfur-containing craked petroleum fraction in the gasoline boiling range is hydrotreated, in a first stage, under conditions which remove at least a substantial proportion of the sulfur. Hydrotreated intermediate product is then treated, in a second stage, by contact with a catalyst of acidic functionality under conditions which convert the hydrotreated intermediate product fraction to a fraction in the gasoline boiling range of higher octane value.

THE DRAWINGS

DETAILED DESCRIPTION

Feed

Figure 1:
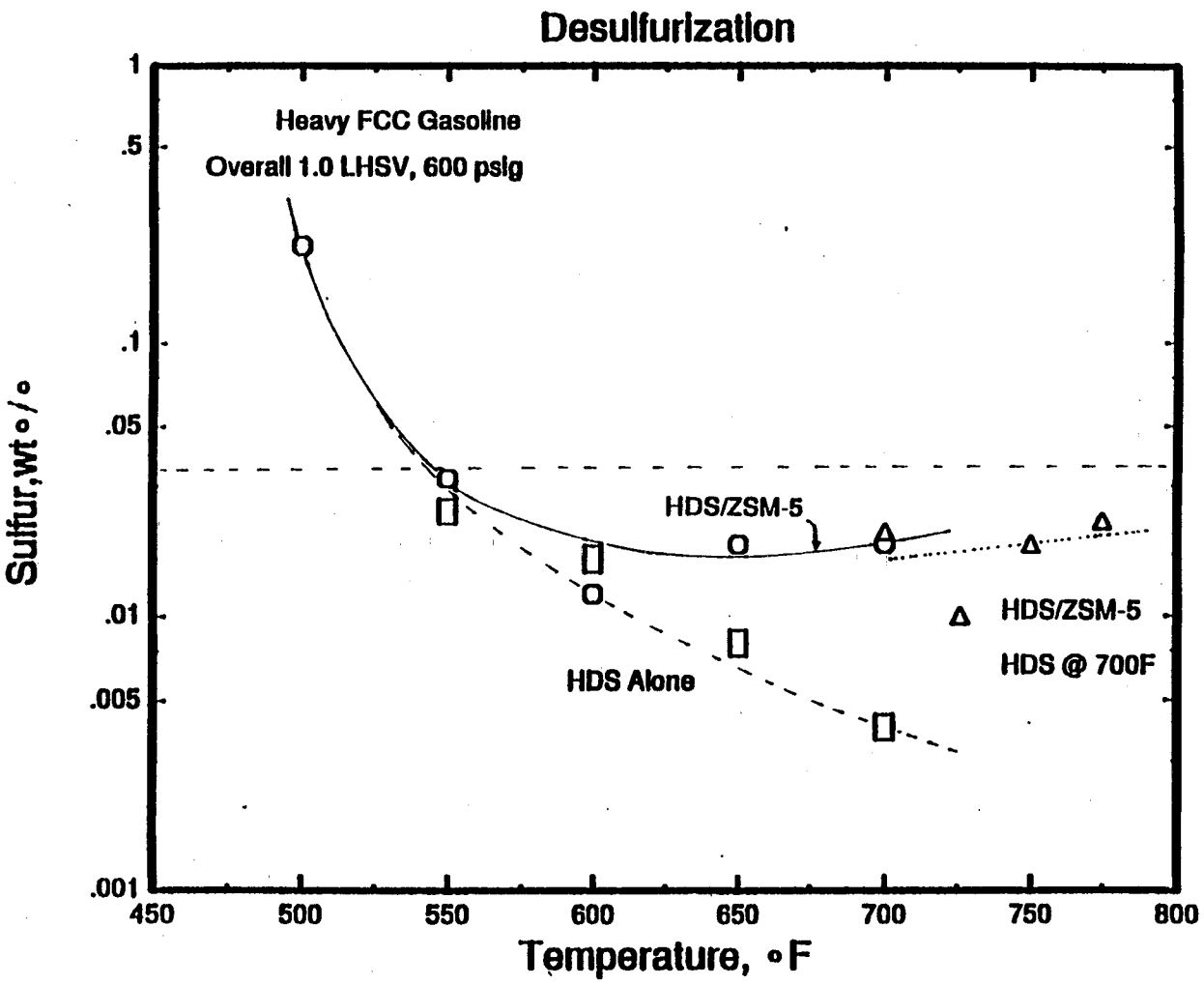
FIG. 1 is a series of plots of the sulfur content of the product as a function of the operating temperature of hydrotreating and second stage conversion using a ZSM-5 catalyst in the second process step.

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (1770° C.), for example, 95 percent points of at least 380° F. (about 193° C.) or at least about 400° F. (about 220° C.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed. This hydrotreated intermediate product which also boils in the gasoline boiling range (and usually has a boiling range which is not substantially higher than the boiling range of the feed), is then treated by contact with an acidic catalyst under conditions which produce a second product comprising a fraction which boils in the gasoline boiling range which has a higher octane number than the portion of the hydrotreated intermediate product fed to this second step. The product form this second step usually has a boiling range which is not substantially higher than the boiling range of the feed to the hydrotreater, but it is of lower sulfur content while having a comparable octane rating as the result of the second stage treatment.

The catalyst used in the second stage of the process has a significant degree of acid activity, and for this purpose the most preferred materials are the crystalline refractory solids having an intermediate effective pore size and the topology of a zeolitic behaving material, which, in the aluminosilicate form, has a constraint index of about 2 to 12.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{31\ 1}$). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an upflow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5+$) materials may occur.

Octane Restoration—Second Step Processing

After the hydrotreating step, the hydrotreated intermediate product is passed to the second step of the process in which cracking takes place in the presence of the acidic functioning catalyst. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

The separation of the light ends at this point may be desirable if the added complication is acceptable since the saturated $C_4$-$C_6$ fraction from the hydrotreater is a highly suitable feed to be sent to the isomerizer for conversion to iso-paraffinic materials of high octane rating; this will avoid the conversion of this fraction to non-gasoline ($C_5-$) products in the second stage of the process. Another process configuration with potential advantages is to take a heart cut, for example, a 195°-302° F. (90°-150° C.) fraction, from the first stage product and send it to the reformer where the low octane naphthenes which make up a significant portion of this fraction are converted to high octane aromatics. The heavy portion of the first stage effluent is, however, sent to the second step for restoration of lost octane by treatment with the acid catalyst. The hydrotreatment in the first stage is effective to desulfurize and denitrogenate the catalytically cracked naphtha which permits the heart cut to be processed in the reformer. Thus, the preferred configuration in this alternative is for the second stage to process the $C_8+$ portion of the first stage effluent and with feeds which contain significant amounts of heavy components up to about $C_{13}$ e.g. with $C_9$-$C_{13}$ fractions going to the second stage, improvements in both octane and yield can be expected.

The conditions used in the second step of the process are those which result in a controlled degree of shape-selective cracking of the desulfurized, hydrotreated effluent from the first step produces olefins which restore the octane rating of the original, cracked feed at least to a partial degree. The reactions which take place during the second step are mainly the shape-selective cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating×volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$) preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5-$) during the second stage is held to a minimum. However, because the cracking of the heavier portions of the feed may lead to the production of products still within the gasoline range, no not conversion to $C_5-$ products may take place and, in fact, a net increase in $C_5+$ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials are exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. No. 4,954,325. Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The catalyst should have sufficient acid activity to have cracking activity with respect to the second stage feed (the intermediate fraction), that is sufficient to convert the appropriate portion of this material as feed. One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis*, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis*, 61, 395 (1980).

The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions as well as possibly bringing about recombination of inorganic sulfur. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the second conversion catalyst will usually be determined by the type of conversion process which is being carried out, such as: a down-flow, liquid phase, fixed bed process; an upflow, fixed bed, liquid phase process; an ebulating, fixed fluidized bed liquid or gas phase process; or a liquid or gas phase, transport, fluidized bed process, as noted above, with the fixed-bed type of operation preferred.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

Further increases in the volumetric yield of the gasoline boiling range fraction of the product, and possibly also of the octane number (particularly the motor octane number), may be obtained by using the $C_{3}$-$C_{4}$ portion of the product as feed for an alkylation process to produce alkylate of high octane number. The light ends from the second step of the process are particularly suitable for this purpose since they are more olefinic than the comparable but saturated fraction from the hydrotreating step. Alternativley, the olefinic light ends from the second step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In one example of the operation of this process, it is reasonable to expect that, with a heavy cracked naphtha feed, the first stage hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the sulfur content is high in the feed, that this octane reduction could go as high as about 15%.

The second stage of the process should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

EXAMPLES

The following examples illustrate the operation of the present process. In these examples, parts and percentages are by weight unless they are expressly stated to be on some other basis. Temperatures are in °F. and pressures in psig, unless expressly stated to be on some other basis.

In the following examples, unless it is indicated that there was some other feed, the same heavy cracked naphtha, containing 2% sulfur, was subjected to processing as set forth below under conditions required to allow a maximum of only 300 ppmw sulfur in the final gasoline boiling range product. The properties of this naphtha feed are set out in Table 1 below.

TABLE 1

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |

TABLE 1-continued

| Heavy FCC Naphtha | |
|---|---|
| Aromatics | 73.2 |
| Distillation, ASTM D-2887, | °F./°C. |
| 5% | 289/143 |
| 10% | 355/207 |
| 30% | 405/224 |
| 50% | 435/234 |
| 70% | 455/253 |
| 90% | 482 |
| 95% | 488 |

Table 2 below sets out the properties of the catalysts used in the two operating conversion stages:

TABLE 2

| | Catalyst Properties | |
|---|---|---|
| Composition, wt % | Hydrodesulfurization 1st stage Catalyst | ZSM-5[1] 2nd stage Catalyst |
| Nickel | — | 1.0 |
| Cobalt | 3.4 | — |
| $moO_3$ | 15.3 | — |
| Physical Properties | | |
| Particle Density, g/cc | — | 0.98 |
| Surface Area, $m^2/g$ | 260 | 336 |
| Pore Volume, cc/g | 0.55 | 0.65 |
| Pore Diameter, A | 85 | 77 |

[1]65 wt % ZSM-5 and 35 wt % alumina

Both stages of the process were carried out in an isothermal pilot plant at the same conditions in the following examples: pressure of 600 psig, space velocity of 1 LHSV, a hydrogen circulation rate of 3200 SCF/Bbl (4240 kPa abs, 1 $hr.^{-1}$ LHSV, 570 $n.l.l^{-1}$.). experiments were run at reactor temperatures from 500° to 775° F. (about 260° to 415° C.).

In all the examples, the process according to the invention was operated in a cascade mode with both catalyst bed/reaction zones operated at the same pressure and space velocity and with no intermediate separation of the intermediate product of the hydrodesulfurization.

Comparison Examples (HDS Only)

Figure 2:
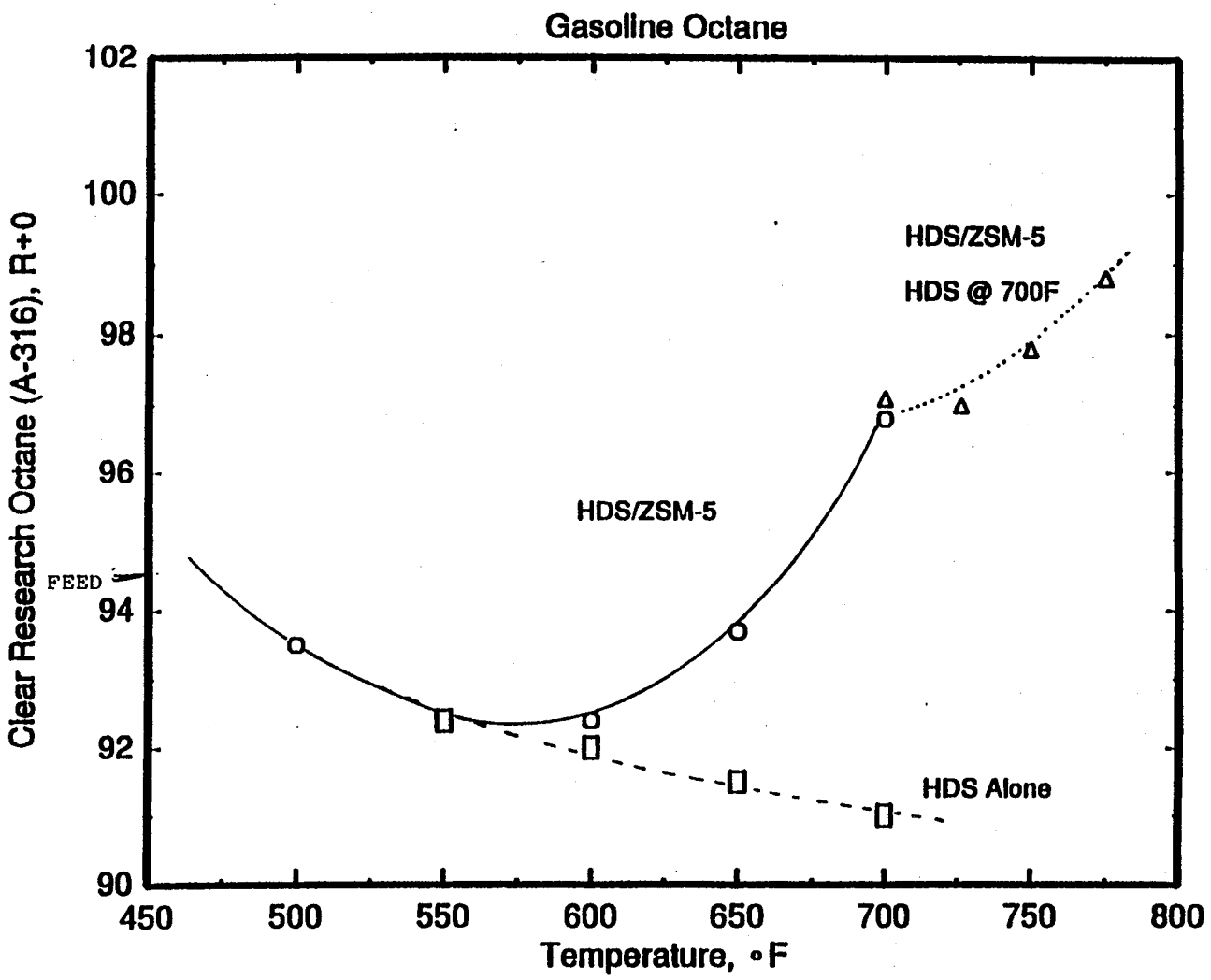
FIG. 2 is a series of plots of the octane number of the product as a function of the operating temperature with a ZSM-5 catalyst in the second process step.

The process was operated with only a hydrodesulfurization reaction zone. At a reaction temperature of 550° F. (288° C.), the product had a sulfur content of about 300 ppmw, and a clear research octane of about 92.5. As the temperature of the desulfurization was increased, the sulfur content and the octane number continued to decline, as shown in FIGS. 1 and 2 (curves HDS Alone).

Examples of HDS Followed by ZSM-5 Upgrading with Both Beds at the Same Temperature The hydrodesulfurization was run in cascade with ZSM-5 upgrading without intermediate hydrogen sulfide separation, with both beds under isothermal conditions. The results are again shown in FIGS. 1 and 2 (curves HDS/ZSM-5).

At a reaction temperature of 550° F. (288° C.), the product had slightly higher or about the same sulfur content as the hydrodesulfurization alone, that is a sulfur content of about 300 ppmw, and about the same clear research octane of about 92.5. As the temperature was increased to 600° F. (315° C.), the sulfur content of the product declined to about 200 ppmw, below that of the hydrodesulfurization alone; the octane number started to increase for the cascade operation as compared to the hydrodesulfurization alone.

When the operation was carried out at an operating temperature of 685° F. (363° C.), the octane number of the finished product was substantially the same as that of the feed naphtha, at 95.6 (clear-research), which is 4.6 octane units higher than the octane number for the same operation using only hydrodesulfurization without second step upgrading, while meeting the desired sulfur content specifications.

Examples of HDS Followed by ZSM-5 Upgrading with HDS at 700° F. (370° C.)

The HDS bed was operated at 700° F. (370° C.) and the ZSM-5 bed at a higher temperature (up to 775° F., 413° C.) to simulate a temperature increase across the HDS bed. The octane of the product gasoline was increased to 99 (clear research). The desulfurization achieved was sufficient to meet the 300 ppmw specification, as shown in FIGS. 1 and 2.

Figure 3:
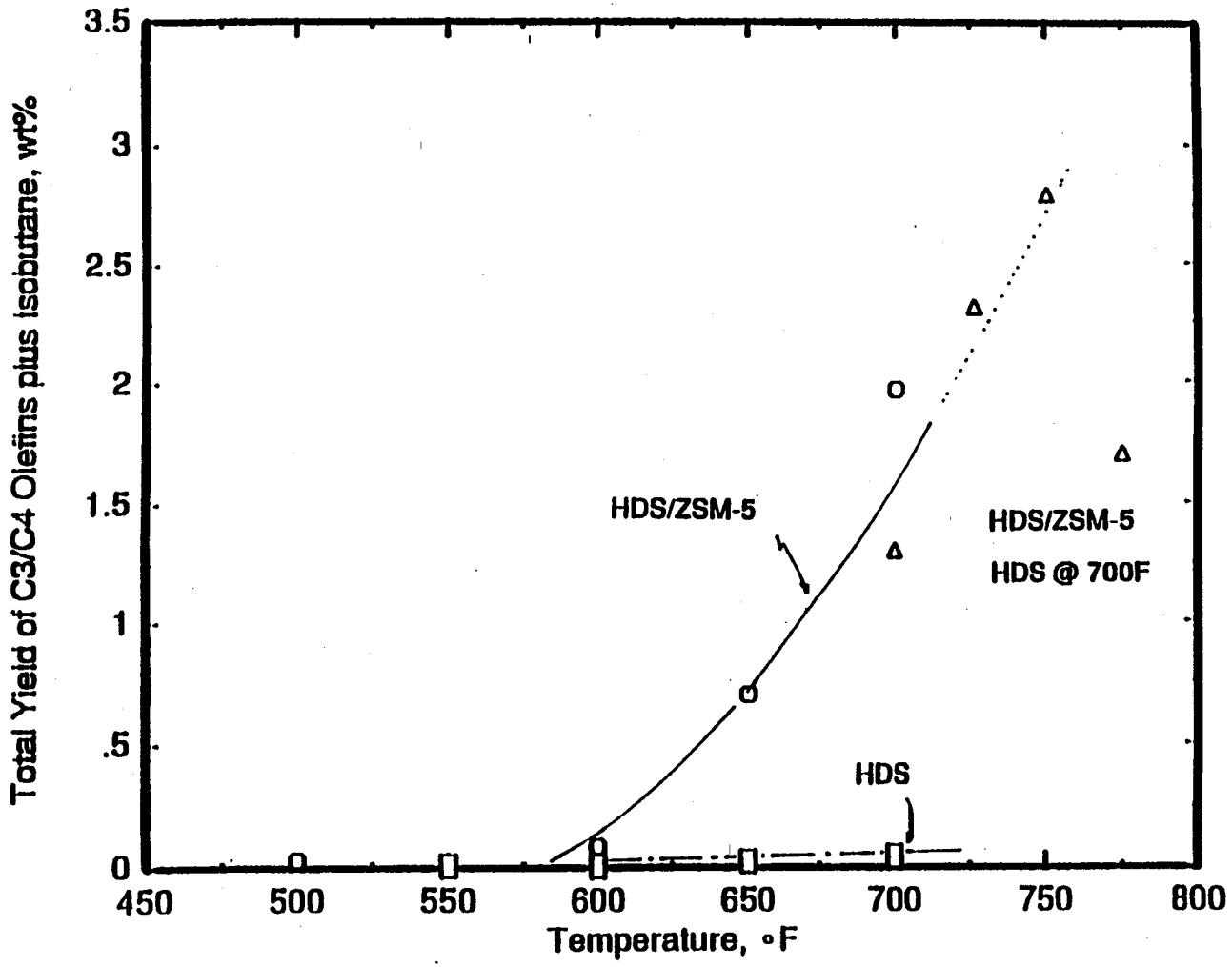
FIG. 3 is a plot of the yield of $C_3/C_4$ olefins plus isobutene as a function of the operating temperature using a ZSM-5 catalyst in the second process step.

When operating with the second stage of the process there is a substantial production of propylene, butenes and isobutane, as shown in FIG. 3 which reports the yields of these materials as a function of the operating temperatures. Using hydrodesulfurization alone, it will be apparent that substantially no $C_3$ and $C_4$ compounds are produced. By contrast, with the combination process, whether operated at constant temperature or with the ZSM-5 bed at higher temperature, there is a substantial quantity of these light materials formed, and the proportion formed increases with temperature.

Therefore, operating the process at progressively higher temperatures increases the production of desirable light fractions, increases the octane number of the gasoline boiling range product fractions, and effectively desulfurizes the gasoline boiling range product to a sufficient extent.

Examples of Combined HDS/ZSM-5 Upgrading with Feeds of Differing Boiling Range The feed was cascaded from the first stage hydrodesulfurization to the second stage (ZSM-5) upgrading without intermediate separation between to two stages. The intermediate product resulting from the hydrodesulfurization stage conversion had properties, including sulfur content and octane number, which were consistent with the properties of the same type of feed converted in a conventional commercially operating hydrotreater. The product resulting from the second stage upgrading has physical properties, including sulfur content and octane number, which demonstrate the improvement obtained by the two-stage operation. The operating conditions were 0.84 LHSV ($hr.^{-1}$),3200 SCF/Bbl (570 $n.l.l^{-1}$.) hydrogen:oil and 600 psig (4240 kPa abs) pressure with the temperature varied as described below. The results are set out in Table 3 below.

A full range FCC naphtha was hydrodesulfurized in Cases 1 and 2 in a first (HDS) reaction zone at 700° F. (370° C.). There was substantially complete sulfur removal from the feed at a substantial loss in octane number. In Case 1, the second stage zeolitic upgrading was carried out under relatively mild conditions and served to minimize the loss of octane. In Case 2, operating the second stage conversion at higher severity caused the octane number of the final product to more closely approach that of the feed. Cases 3 and 4 show the same results achieved with a feed of somewhat heavier FCC naphtha.

TABLE 3

| | HDS/ZSM-5 Upgrading of FCC Naphtha Cuts | | | |
|---|---|---|---|---|
| Cases | 1 | 2 | 3 | 4 |
| Reactor 1 Temp., °F. | 700 | 700 | 700 | 700 |
| Reactor 2 Temp., °F. | 700 | 750 | 700 | 750 |
| Feed | | | | |
| Boiling Range, °F. | 95–500 | 95–500 | 230–500 | 230–500 |
| API Gravity | 54.3 | 54.3 | 34.2 | 34.2 |
| Sulfur, ppmw | 3800 | 3800 | 5200 | 5200 |
| Nitrogen, ppmw | 44 | 44 | 85 | 85 |
| Bromine No. | 45.81 | 45.81 | 13.86 | 13.86 |
| Research Octane | 93.5 | 93.5 | 95.8 | 95.8 |
| Motor Octane | 81.6 | 81.6 | 83.5 | 83.5 |
| Wt % $C_{5++}$ | 99.8 | 99.8 | 100.0 | 100.0 |
| Vol % $C_5$ | 99.8 | 99.8 | 100.0 | 100.0 |
| Reactor 1 Product | | | | |
| Sulfur, ppmw | <20 | <20 | <20 | <20 |
| Nitrogen, ppmw | 2 | 2 | <1 | <1 |
| Bromine No. | 0.11 | 0.11 | 0.03 | 0.03 |
| Research Octane | 80.8 | 80.8 | 89.3 | 89.3 |
| Motor Octane | 75.3 | 75.3 | 78.4 | 78.4 |
| Wt % $C_5$ | 99.2 | 99.2 | 100.2 | 100.2 |
| Vol % $C_{5+}$ | 97.6 | 97.6 | 102.2 | 102.2 |
| Vol % $C_3$ Olefins | 0.0 | 0.0 | 0.0 | 0.0 |
| Vol % $C_4$ Olefins | 0.0 | 0.0 | 0.0 | 0.0 |
| Vol % Isobutane | 0.0 | 0.0 | 0.0 | 0.0 |
| Potential Alkylate, vol %(1) | 0.0 | 0.0 | 0.0 | 0.0 |
| Reactor 2 Product | | | | |
| Sulfur, ppmw | <20 | <20 | <20 | <20 |
| Nitrogen, ppmw | <1 | <1 | <1 | <1 |
| Bromine No. | 1.63 | 1.49 | 1.51 | 0.91 |
| Research Octane | 87.4 | 92.9 | 93.2 | 97.3 |
| Motor Octane | 80.2 | 84.5 | 82.0 | 86.2 |
| Wt % $C_5$ | 94.9 | 82.7 | 97.3 | 91.0 |
| Vol % $C_{5+}$ | 92.5 | 80.4 | 98.7 | 91.7 |
| Vol % $C_3$ Olefins | 0.2 | 0.3 | 0.2 | 0.3 |
| Vol % $C_4$ Olefins | 0.4 | 0.4 | 0.5 | 0.4 |
| Vol % Isobutane | 1.6 | 5.8 | 1.0 | 3.7 |

TABLE 3-continued

| HDS/ZSM-5 Upgrading of FCC Naphtha Cuts | | | | |
|---|---|---|---|---|
| Cases | 1 | 2 | 3 | 4 |
| Potential Alkylate, Vol % | 1.0 | 1.2 | 1.2 | 1.2 |

(1)Potential alkylate defined as 1.7 × ($C_4^=$ + $C_3^=$, % vol).

Examples of the Effect of HDS Severity on ZSM-5 Upgrading

In the two cases illustrated here, the second (ZSM-5) stage, the temperature was held constant at 700° F. (370° C.) while the HDS temperature was varied to either 350° F. (177° C.) or 550° F. (288° C.) at 0.84 LHSV (hr.$^{-1}$, 3200 SCF/Bbl (570 n.l.l$^{-1}$) hydrogen:oil 600 psig (4240 kPa abs) pressure. The results are shown in Table 4 below.

Case 1 demonstrates the results of upgrading cracked naphtha with ZSM-5 without prior hydrotreatment. During the experiment, the temperature of the first reactor was 350° F., which is sufficiently low to make this stage hydrotreating ineffective and made this first stage merely a pre-heater. The second stage alone did not remove the required amount of sulfur.

In Case 2, mild hydrotreatment prior in the first stage did achieve the required desulfurization. However, the first stage of hydrotreatment completely saturated the olefins in the feed, as indicated by the bromine number reduction, and this resulted in a 9 number loss of research octane. The second stage processing over the ZSM-5 catalyst restored the lost octane.

TABLE 4

| Effect of Hydrotreating Severity on ZSM-5 Upgrading of FCC Naphtha | | |
|---|---|---|
| Case | 1 | 2 |
| Reactor 1 Temp., °F. | 350 | 550 |
| Reactor 2 Temp., °F. | 700 | 700 |
| Feed | | |
| Boiling Range, °F. | 95–500 | 95–500 |
| API Gravity | 54.3 | 54.3 |
| Sulfur, ppmw | 3800 | 3800 |
| Nitrogen, ppmw | 44 | 44 |
| Bromine No. | 45.81 | 45.81 |
| Research Octane | 93.5 | 93.5 |
| Motor Octane | 81.6 | 81.6 |
| Wt % $C_5$+ | 99.8 | 99.8 |
| Vol % $C_5$+ | 99.8 | 99.8 |
| Reactor 1 Product | | |
| Sulfur, ppmw | — | <20 |
| Nitrogen, ppmw | — | 3 |
| Bromine No. | — | 0.08 |
| Research Octane | — | 84.5 |
| Motor Octane | — | 76.8 |
| Wt % $C_5$+ | — | 99.3 |
| Vol % $C_5$+ | — | 96.2 |
| Vol % $C_3$ Olefins | — | 0.0 |
| Vol % $C_4$ Olefins | — | 0.0 |
| Vol % Isobutane | — | 0.0 |
| Potential Alkylate Vol % | — | 0.0 |
| Reactor 2 Product | | |
| Sulfur, ppmw | 1700 | 30 |
| Nitrogen, ppmw | 25 | <1 |
| Bromine No. | 12.70 | 1.40 |
| Research Octane | 94.0 | 90.0 |
| Motor Octane | 83.7 | 82.0 |
| Wt % $C_5$+ | 94.3 | 94.7 |
| Vol % $C_5$+ | 88.8 | 92.0 |
| Vol % $C_3$ Olefins | 0.5 | 0.2 |
| Vol % $C_4$ Olefins | 1.1 | 0.4 |
| Vol % Isobutane | 1.9 | 1.6 |
| Potential Alkylate vol % | 2.7 | 1.0 |

Examples with Zeolites Other Than ZSM-5 (Second Step)

These evaluations were conducted in a similar manner to those described above for the HDS/ZSM-5 studies using an isothermal pilot plant with both reaction zones at the same temperature (700° F., 370° C.) and $H_2$ pressure (600 psig, 4240 kPa). The same Co-Mo/$Al_2O_3$ hydrotreating catalyst was used but the second stage catalysts were MCM-22 and zeolite beta. The zeolite beta catalyst was prepared from a steamed H-beta zeolite and the MCM-22 catalyst from unsteamed H-MCM-22 with alumina binder in each case. The feed was a heavy catalytically cracked gasoline similar to that used in the ZSM-5 studies; its properties are shown in Table 5 together with those for the feed used in the ZSM-5 studies.

The results are given below in Table 6 together the results obtained with the ZSM-5 catalyst at 700° F. (370° C.) for comparison. The results are also shown graphically in FIGS. 4 to 6.

TABLE 5

| Feed Properties - Heavy Gasoline | | |
|---|---|---|
| Catalyst | MCM-22/Beta | ZSM-5 |
| H, wt % | 10.64 | 10.23 |
| S, wt % | 1.45 | 2.0 |
| N, wt % | 170 | 190 |
| Bromine No. | 11.7 | 14.2 |
| Paraffins, vol % | 24.3 | 26.5 |
| Research Octane | 94.3 | 95.6 |
| Motor Octane | 82.8 | 81.2 |
| Distillation, D 2887 (F°/C°) | | |
| 5% | 284/140 | 289/143 |
| 30% | 396/202 | 405/207 |
| 50% | 427/219 | 435/224 |
| 70% | 451/233 | 453/234 |
| 95% | 492/256 | 488/253 |

TABLE 6

| Catalyst Evaluations | | | |
|---|---|---|---|
| | Ni ZSM-5 | MCM-22 | Beta |
| 420° + F Conv., % | 15.6 | 27.4 | 31.4 |
| $C_3$=, wt % | 0.22 | 0.14 | 0.08 |
| $C_4$=, wt % | 0.51 | 1.10 | 0.35 |
| $C_5$=, wt, % | 0.47 | 1.90 | 0.49 |
| Paraffins | | | |
| Branched $C_4$, wt % | 1.00 | 1.21 | 1.47 |
| Branched $C_5$, wt % | 0.86 | 0.72 | 1.60 |

Figure 4:
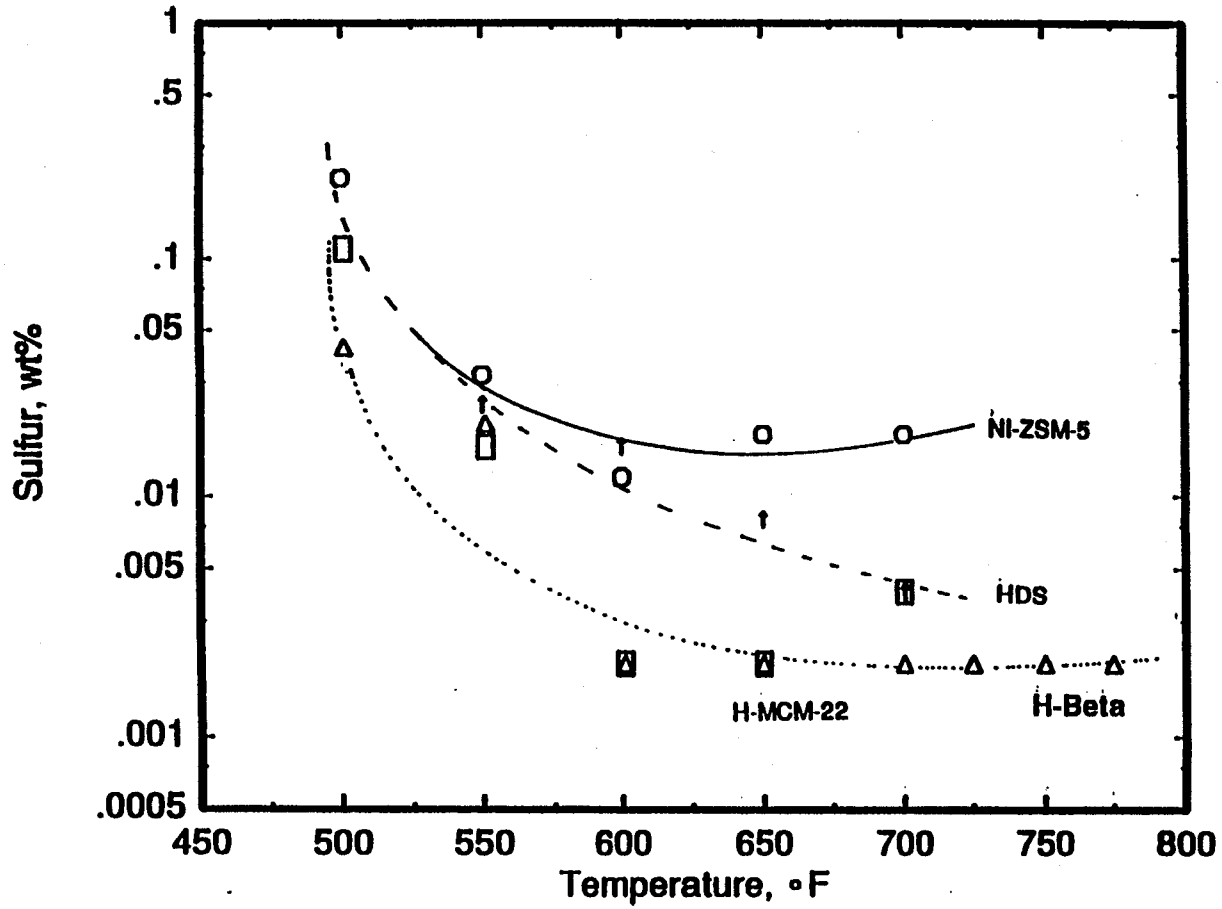
FIG. 4 is a series of plots of the sulfur content of the product as a function of the operating temperature of hydrotreating and second stage conversion with three different catalysts in the second process step.
Figure 5:
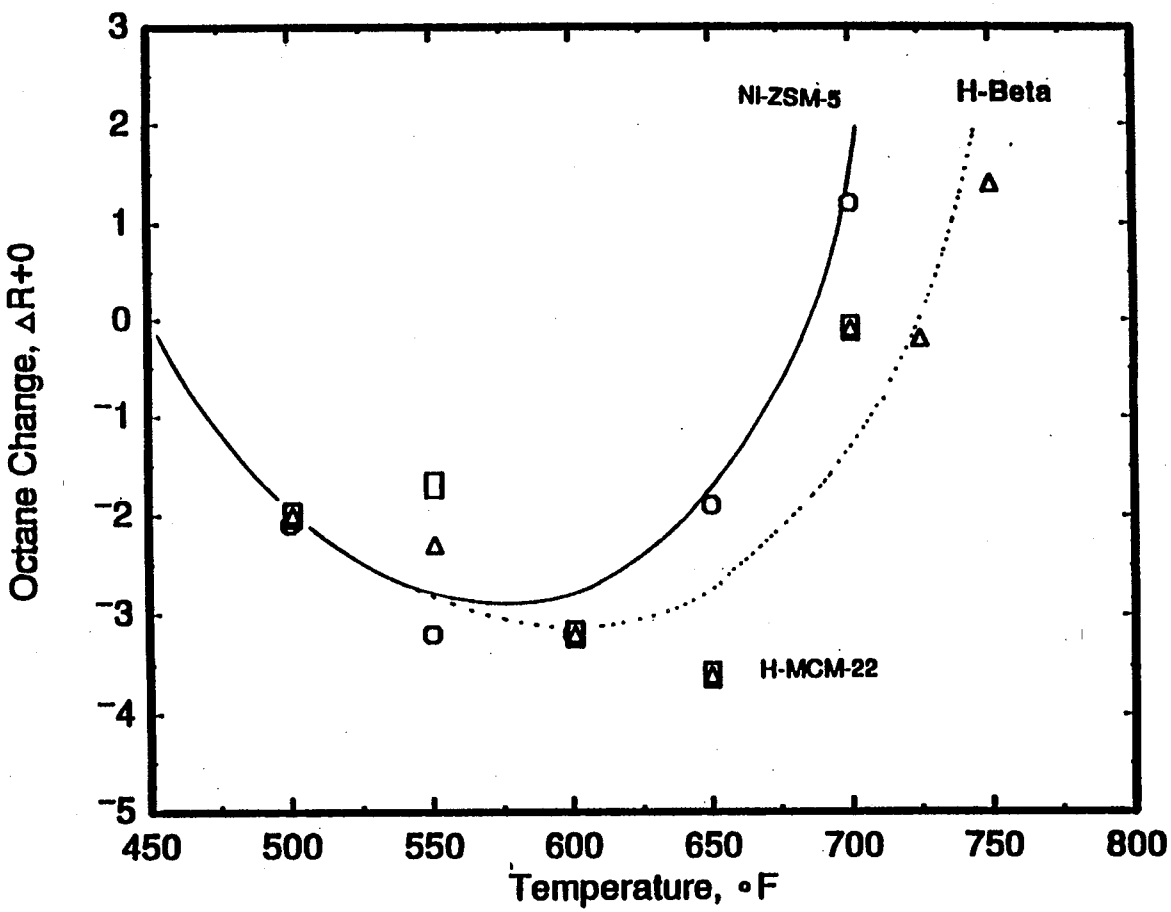
FIG. 5 is a series of plots of the octane number of the product as a function of the operating temperature with three different catalysts in the second process step.
Figure 6:
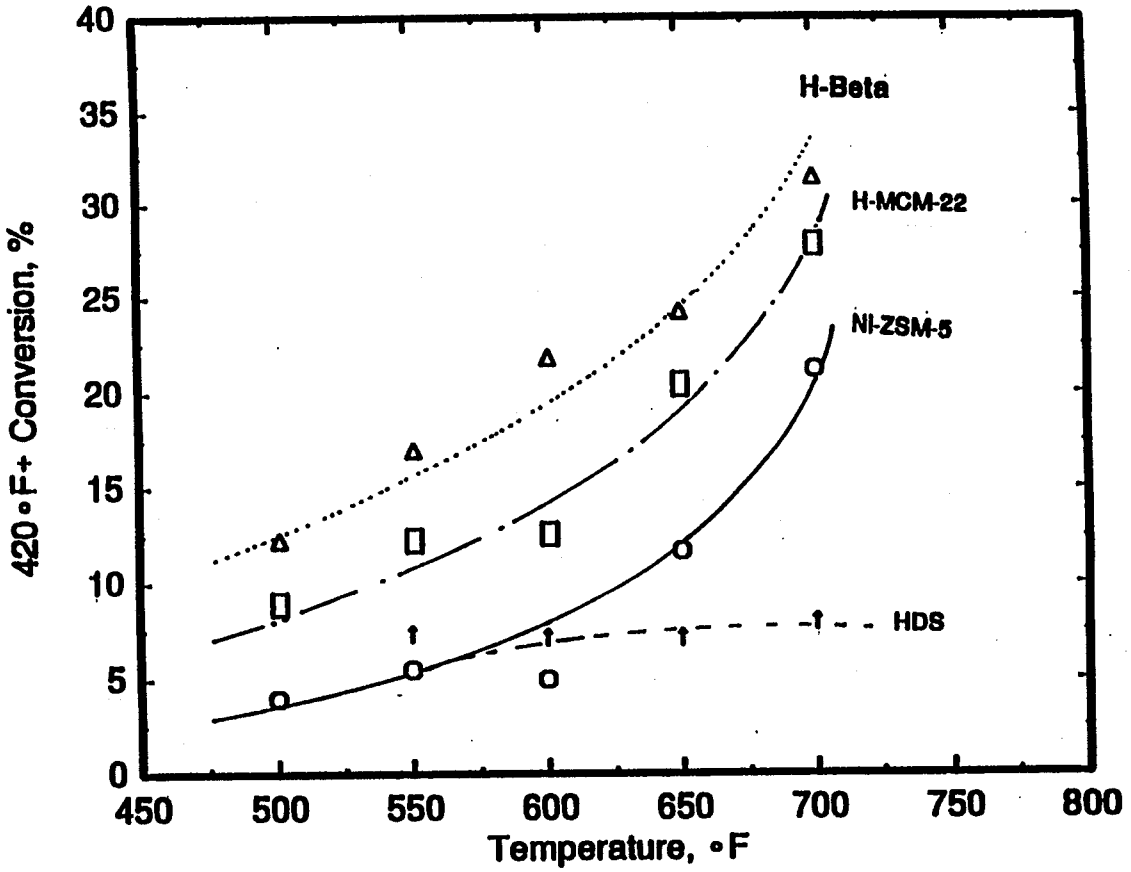
FIG. 6 is a plot of the back-end conversion of the feed using three different catalysts in the second processing step.

These results show that both zeolite beta and MCM-22 are more active for 420° F.+ (215° C.+) conversion (FIG. 6) than the ZSM-5 but slightly less effective for octane enhancement than ZSM-5 (FIG. 5). The MCM-22 catalyst, however, produces more $C_4/C_5$ olefins than either ZSM-5 or zeolite beta (Table 6). The zeolite beta catalyst has a very high yield of isobutanes and isopentanes (Table 6). The desulfurization performances are shown in FIG. 4. The H-form beta and MCM-22 achieved desulfurization to less than 25 ppmw as compared to 180 ppmw for the NiZSM-5.

We claim:

1. A process of upgrading a sulfur-containing olefinic, catalytically cracked hydrocarbon naphtha boiling in the gasoline boiling range and having a 95 percent point of at least 325° F., which comprises:

contacting the sulfur-containing, olefinic, cracked naphtha with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality in the presence of hydrogen to effect cracking of heavy paraffins to lighter paraffins and cracking of low octane n-paraffins in the intermediate product to convert it to a product comprising a fraction boiling in the gasoline boiling range having a higher octane number than the gasoline boiling range fraction of the intermediate product.

2. The process as claimed in claim 1 in which said feed fraction comprises a light naphtha fraction having a boiling range within the range of $C_6$ to 330° F.

3. The process as claimed in claim 1 in which said feed fraction comprises a full range naphtha fraction having a boiling range within the range of $C_5$ to 420° F.

4. The process as claimed in claim 1 in which said feed fraction comprises a heavy naphtha fraction having a boiling range within the range of 330° to 500° F.

5. The process as claimed in claim 1 in which said feed fraction comprises a heavy naphtha fraction having a boiling range within the range of 330° to 412° F.

6. The process as claimed in claim 1 in which said feed fraction comprises a naphtha fraction having a 95 percent point of at least about 350° F.

7. The process as claimed in claim 6 in which said feed fraction comprises a naphtha fraction having a 95 percent point of at least about 380° F.

8. The process as claimed in claim 7 in which said feed fraction comprises a naphtha fraction having a 95 percent point of at least about 400° F.

9. The process as claimed in claim 1 in which the acidic catalyst comprises an intermediate pore size zeolite.

10. The process as claimed in claim 9 in which the intermediate pore size zeolite has the topology of ZSM-5.

11. The process as claimed in claim 10 in which the intermediate pore size zeolite is in the aluminosilicate form.

12. The process as claimed in claim 1 in which the acidic catalyst includes a metal component having hydrogenation functionality.

13. The process as claimed in claim 1 in which the hydrodesulfurization catalyst comprises a Group VIII and a Group VI metal.

14. The process as claimed in claim 1 in which the hydrodesulfurization is carried out at a temperature of about 400° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed.

15. The process as claimed in claim 14 in which the hydrodesulfurization is carried out at a temperature of about 500° to 750° F., a pressure of about 300 to 1000 psig, a space velocity of about 1 to 6 LHSV, and a hydrogen to hydrocarbon ratio of about 1000 to 2500 standard cubic feet of hydrogen per barrel of feed.

16. The process as claimed in claim 1 in which the second stage upgrading is carried out at a temperature of about 300° to 900° F., a pressure of about 50 to 1500 psig, a space velocity of about 0.5 to 10 LHSV, and a hydrogen to hydrocarbon ratio of about 0 to 5000 standard cubic feet of hydrogen per barrel of feed.

17. The process as claimed in claim 16 in which the second stage upgrading is carried out at a temperature of about 350° to 800° F., a pressure of about 300 to 1000 psig, a space velocity of about 1 to 6 LHSV, and a hydrogen to hydrocarbon ratio of about 100 to 2500 standard cubic feet of hydrogen per barrel of feed.

18. The process as claimed in claim 1 which is carried out in two stages with an interstage separation of light ends and heavy ends with the heavy ends fed to the second reaction zone.

19. The process as claimed in claim 18 in which the normally liquid intermediate product from the first reaction zone comprises a $C_8+$ fraction having an initial point of at least 210° F.

20. A process of upgrading a sulfur-containing, catalytically cracked, olefinic hydrocarbon naphtha feed fraction boiling in the gasoline boiling range and having a 95 percent point of at least 325° F., which comprises:

hydrodesulfurizing the catalytically cracked, olefinic, sulfur-containing naphtha feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone in the presence of hydrogen with a catalyst of acidic functionality to effect cracking of heavy paraffins to lighter paraffins and cracking of low octane n-paraffins in the intermediate product to convert it to a product comprising a fraction boiling in the gasoline boiling range having a higher octane number than the gasoline boiling range fraction of the intermediate product.

21. The process as claimed in claim 20 in which the feed fraction has a 95 percent point of at least 350° F., an olefin content of 10 to 20 weight percent, a sulfur content from 100 to 5,000 ppmw and a nitrogen content of 5 to 250 ppmw.

22. The process as claimed in claim 21 in which said feed fraction comprises a naphtha fraction having a 95 percent point of at least about 380° F.

23. The process as claimed in claim 20 in which the acidic catalyst of the second reaction zone comprises an intermediate pore size zeolite.

24. The process as claimed in claim 23 in which the intermediate pore size zeolite has the topology of ZSM-5 and is in the aluminosilicate form.

25. The process as claimed in claim 20 in which the acidic catalyst includes a metal component having hydrogenation functionality.

26. The process as claimed in claim 20 in which the hydrodesulfurization is carried out at a temperature of about 500° to 800° F., a pressure of about 300 to 1000 psig, a space velocity of about 1 to 6 LHSV, and a hydrogen to hydrocarbon ratio of about 1000 to 2500 standard cubic feet of hydrogen per barrel of feed.

27. The process as claimed in claim 20 in which the second stage upgrading is carried out at a temperature of about 350° to 800° F., a pressure of about 300 to 1000 psig, a space velocity of about 1 to 6 LHSV, and a hydrogen to hydrocarbon ratio of about 100 to 2500 standard cubic feet of hydrogen per barrel of feed.

28. The process as claimed in claim 20 which is carried out in two stages with an interstage separation of light ends and heavy ends with the heavy ends fed to the second reaction zone.

29. The process as claimed in claim 20 which is carried out in cascade mode with the entire effluent from the first reaction passed to the second reaction zone.

* * * * *